US011655115B2

(12) United States Patent
Ichikawa et al.

(10) Patent No.: US 11,655,115 B2
(45) Date of Patent: May 23, 2023

(54) IMAGE RECORDING APPARATUS

(71) Applicant: BROTHER KOGYO KABUSHIKI KAISHA, Nagoya (JP)

(72) Inventors: Shohei Ichikawa, Niwa-gun (JP); Tsuyoshi Ito, Nagoya (JP); Masatake Sato, Ichinomiya (JP); Keisuke Wakakusa, Nagoya (JP); Yoshimitsu Taniguchi, Tajimi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/206,990

(22) Filed: Mar. 19, 2021

(65) Prior Publication Data

US 2021/0300701 A1 Sep. 30, 2021

(30) Foreign Application Priority Data

Mar. 24, 2020 (JP) ..... JP2020-052680

(51) Int. Cl.

| | |
|---|---|
| ***B65H 7/08*** | (2006.01) |
| ***B65H 5/06*** | (2006.01) |
| *B41J 11/00* | (2006.01) |
| *B41J 11/04* | (2006.01) |

(52) U.S. Cl.

CPC ..... *B65H 7/08* (2013.01); *B65H 5/068* (2013.01); *B41J 11/0095* (2013.01); *B41J 11/04* (2013.01)

(58) Field of Classification Search

CPC . B65H 85/00; B65H 7/08; B65H 5/068; B41J 11/0095; B41J 11/04

See application file for complete search history.

(56) References Cited

U.S. PATENT DOCUMENTS

| | | | | |
|---|---|---|---|---|
| 9,428,355 | B2 * | 8/2016 | Asai | B65H 5/068 |
| 9,443,173 | B2 * | 9/2016 | Taguchi | B65H 5/062 |
| 2015/0334263 | A1 * | 11/2015 | Chubachi | B41J 11/009 358/475 |
| 2017/0282606 | A1 | 10/2017 | Yatsunami et al. | |

(Continued)

FOREIGN PATENT DOCUMENTS

| | | | |
|---|---|---|---|
| JP | 2003176045 | A | 6/2003 |
| JP | 2006143411 | A | 6/2006 |

(Continued)

*Primary Examiner* — Thomas A Morrison

(74) *Attorney, Agent, or Firm* — Merchant & Gould P.C.

(57) ABSTRACT

An image recording apparatus including: a recording unit; an accommodation part configured to accommodate therein a plurality of recording media including first and second recording medium and having a support surface on which the plurality of the recording media is supported; a conveying path; a feeder roller contacting the recording medium in the accommodation part from above; a reversing path; a recording medium detection unit located above the support surface and between the feeder roller and a downstream end of the support surface in the conveying direction; and a controller configured to control the feeder roller so as to feed the second recording medium in a manner that a front end portion of the second recording medium overlaps a rear end portion of the first recording medium, when the recording medium detection unit detects the rear end portion of the first recording medium fed by the feeder roller.

11 Claims, 5 Drawing Sheets

(56) References Cited

U.S. PATENT DOCUMENTS

| | | | | |
|---|---|---|---|---|
| 2017/0282609 | A1 | 10/2017 | Yatsunami | |
| 2017/0334219 | A1 | 11/2017 | Ito | |
| 2020/0024092 | A1 * | 1/2020 | Taniguchi ..... | B65H 85/00 |

FOREIGN PATENT DOCUMENTS

| | | | |
|---|---|---|---|
| JP | 2010271405 | A | 12/2010 |
| JP | 2017177619 | A | 10/2017 |
| JP | 2017209811 | A | 11/2017 |

* cited by examiner

IMAGE RECORDING APPARATUS

CROSS-REFERENCE TO RELATED APPLICATIONS

This application is based upon and claims the benefit of priority from prior Japanese patent application No. 2020-052680, filed on Mar. 24, 2020, the entire contents of which are incorporated herein by reference.

TECHNICAL FIELD

Aspects of the present disclosure relate to an image recording apparatus, and in particular, to an image recording apparatus configured to perform overlapping conveyance.

BACKGROUND ART

Known is an image recording apparatus that, when performing image recording while conveying a plurality of sheet-shaped recording media, performs overlapping conveyance of conveying the recording media by causing a front end portion of a subsequent recording medium to overlap a rear end portion of a preceding recording medium.

Related art discloses a configuration where a lever is provided in a conveying path of a recording medium, a detection sensor is provided on a further upstream side than the lever in the conveying direction, and a rear end portion of a preceding recording medium detected by the detection sensor is pressed downward by the lever, thereby causing the rear end portion to overlap a front end portion of a subsequent recording medium.

Related art also discloses a configuration where a part of a conveying path configuring a lower side guide surface is arranged in a position higher than a downstream side of the part in a conveying direction and a subsequent recording medium is conveyed in a position higher than a preceding recording medium, thereby causing the recording media to overlap each other.

However, according to the configurations disclosed in the related art, a mechanism configured to perform overlapping conveyance becomes complicated. Also, the conveying path becomes large, so that the image recording apparatus is also enlarged.

SUMMARY

An aspect of the present disclosure provides an image recording apparatus configured to overlap and convey recording media, in which the image recording apparatus is prevented from being enlarged, and in which a mechanism configured to perform overlapping conveyance is suppressed from being complicated.

According to an aspect of the present disclosure, there is provided an image recording apparatus including: a recording unit configured to perform recording on a sheet-shaped recording medium; an accommodation part configured to accommodate therein a plurality of recording media and having a support surface on which the plurality of the recording media is supported in a stacked manner, the plurality of the recording media including a first recording medium and a second recording medium, and the first recording medium being stacked on the second recording medium; a conveying path along which the recording medium is conveyed from the accommodation part to the recording unit; a feeder roller pivotally supported so as to contact the recording medium accommodated in the accommodation part from above, the feeder roller being configured to sequentially feed the plurality of recording media in a conveying direction of the recording medium; a reversing path configuring at least a part of the conveying path between the accommodation part and the recording unit, the reversing path being configured to convey the recording medium while reversing front and rear surfaces of the recording medium; a recording medium detection unit located above the support surface and between the feeder roller and a downstream end of the support surface in the conveying direction, the recording medium detection unit being configured to detect the recording medium fed by the feeder roller; and a controller configured to control the feeder roller so as to feed the second recording medium in a manner that a front end portion of the second recording medium overlaps a rear end portion of the first recording medium, the control being performed by the controller when the recording medium detection unit detects the rear end portion of the first recording medium fed by the feeder roller.

DESCRIPTION OF EMBODIMENTS

Hereinbelow, each embodiment will be described with reference to the drawings.

First Embodiment

Figure 1:
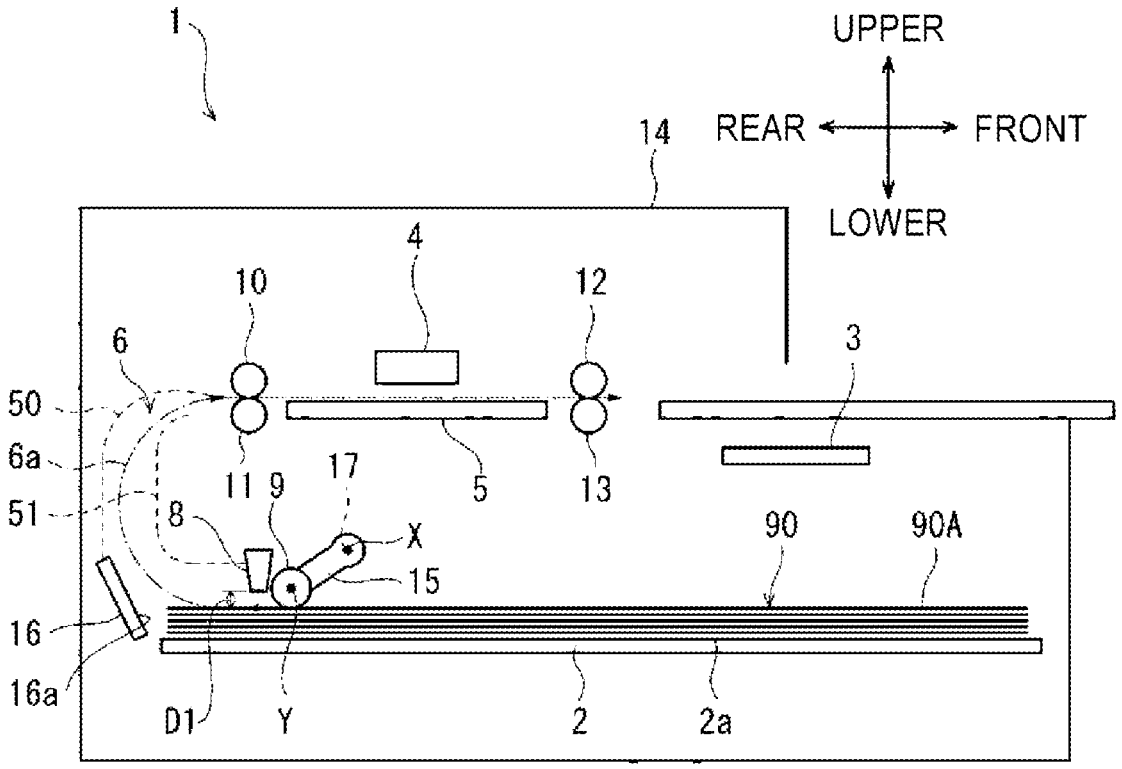
FIG. 1 is a schematic configuration view of an image recording apparatus according to a first embodiment.
Figure 2:
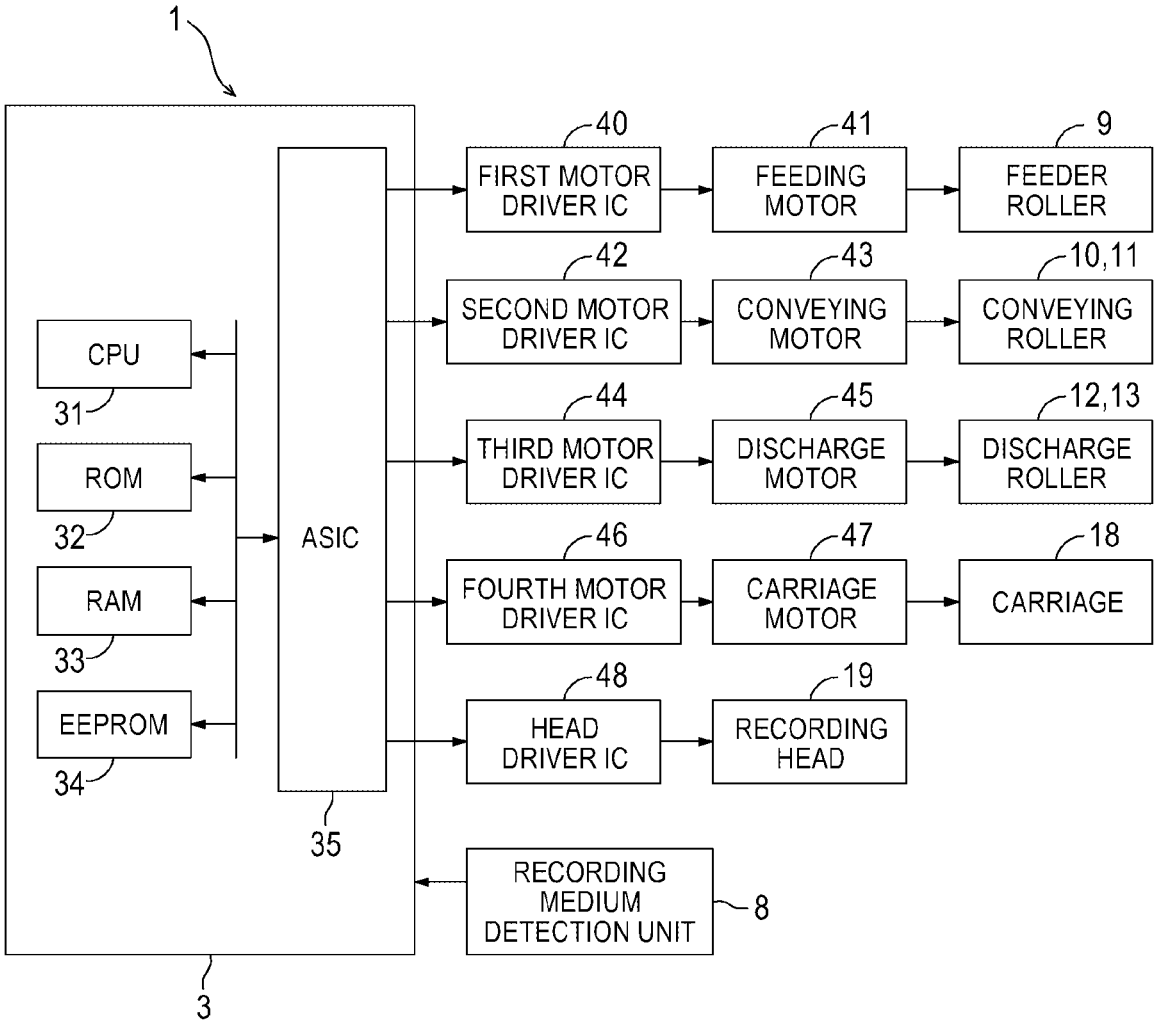
FIG. 2 is a functional block diagram of the image recording apparatus shown in FIG. 1.

FIG. 1 is a schematic configuration view of an image recording apparatus 1 according to a first embodiment. FIG. 2 is a functional block diagram of the image recording apparatus 1 shown in FIG. 1. The image recording apparatus 1 includes an accommodation part 2 and a controller 3. The accommodation part 2 is configured to accommodate therein a plurality of sheet-shaped recording media 90 and has a support surface 2*a* on which the plurality of recording media 90 is supported in a stacked manner. The recording media 90 includes a first recording medium 90A and a second recording medium 90B. The first recording medium 90A is stacked on the second recording medium 90B. As described in detail later, while performing a print job on a plurality of recording media 90, when a recording medium detection unit 8 detects a rear end portion of the first recording medium 90A fed by a feeder roller 9, the controller 3 of the image recording apparatus 1 executes overlapping processing of controlling the feeder roller 9 so as to feed the second recording medium 90B so that a front end portion of the second recording medium 90B overlaps the rear end portion of the first recording medium 90A. Thereby, in the print job, a recording operation of recording image data on each of the recording media 90 is efficiently performed.

Specifically, as shown in FIGS. 1 and 2, the image recording apparatus 1 of the present embodiment includes a housing 14, a recording unit 4 configured to perform recording on the recording medium 90, a platen 5 facing the recording unit 4 with a gap in a predetermined direction (for example, an upper and lower direction) and configured to support the recording medium 90 to be recorded by the recording unit 4, and a conveying path 6 along which the recording medium 90 is conveyed from the accommodation part 2 to the recording unit 4. The recording unit 4 includes a recording head 19 having ink nozzles for ejecting ink supplied from an outside toward the recording medium 90, and a carriage 18 on which the recording head 19 is mounted. The platen 5 extends in a horizontal direction, for example.

The conveying path 6 is formed to be curved as a whole. The conveying path 6 shown in FIG. 1 extends, for example, from a downstream end, in a predetermined conveying direction, of the uppermost recording medium 90 (here, the first recording medium 90A) accommodated in the accommodation part 2 toward the rear and upper side of the image recording apparatus 1 and then extends forward. The conveying path 6 has a reversing path 6*a*. The reversing path 6*a* configures at least a part of the conveying path 6 between the accommodation part 2 and the recording unit 4, and is configured to convey the recording medium 90 while reversing front and rear surfaces of the recording medium 90. The image recording apparatus 1 includes an outer guide member 50 defining at least a part of an outer periphery side of the reversing path 6*a* viewed in a direction of a rotation axis Y of the feeder roller 9, and an inner guide member 51 defining at least a part of an inner periphery side of the reversing path 6*a* viewed in the direction of the rotation axis Y of the feeder roller 9. The inner guide member 51 faces the outer guide member 50 at a position closer to the feeder roller 9 than the outer guide member 50.

The image recording apparatus 1 also includes a feeder roller 9, conveying rollers 10 and 11, and discharge rollers 12 and 13. The feeder roller 9 is pivotally supported so as to contact the recording medium 90 accommodated in the accommodation part 2 from above. The feeder roller 9 is configured to sequentially feed the plurality of recording media 90 in the conveying direction. The conveying rollers 10 and 11 are configured to convey the recording medium 90 fed from the accommodation part 2 along the conveying path 6. The discharge rollers 12 and 13 are configured to discharge the recording medium 90 having passed through the recording unit 4 to an outside of the housing 14. The conveying rollers 10 and 11 are arranged in predetermined positions between the feeder roller 9 and the recording unit 4 in the conveying direction. In the image recording apparatus 1, for example, the conveying rollers 10 and 11 are arranged in positions close to an upstream end of the platen 5, and the discharge rollers 12 and 13 are arranged in positions close to a downstream end of the platen 5.

The feeder roller 9 is pivotally supported by a swinging member 15 pivotally supported to be swingable around a rotation axis X. The rotation axis X is arranged in a plane parallel to the support surface 2*a*. An urging member 17 is arranged to be in contact with the swinging member 15 in the vicinity of the swinging member 15. The swinging member 15 is configured to urge the feeder roller 9 toward the support surface 2*a* by an urging force of the urging member 17. Thereby, the feeder roller 9 is always in contact with the recording medium 90 in the accommodation part 2.

The image recording apparatus 1 also includes an inclination part 16 arranged between the accommodation part 2 and the reversing path 6*a* in the conveying direction. The inclination part 16 has an inclined surface 16*a* that is inclined obliquely upward from a downstream end of the accommodation part 2 in the conveying direction toward the reversing path 6*a*. The inclination part 16 is configured to guide the recording medium 90 that is conveyed.

In the image recording apparatus 1, for example, at least a part of the feeder roller 9 is arranged to overlap the support surface 2*a* in the direction perpendicular to the support surface 2*a*, at least a part of the recording medium detection unit 8 is arranged to overlap the support surface 2*a* in the direction perpendicular to the support surface 2*a* and at least a part of the reversing path 6*a* is arranged to overlap the support surface 2*a* in the direction perpendicular to the support surface 2*a*.

As shown in FIG. 2, the controller 3 includes a CPU 31, a ROM 32, a RAM 33, an EEPROM 34, and an ASIC 35. The number of the CPU 31 may be single or plural. In the ROM 32, a control program for the CPU 31 to execute a predetermined job is stored. In the RAM 33, a table showing a relation between an output value L1 of the recording medium detection unit 8 and a distance D1, which will be described later, and information about a preset reference value Ds are stored. In the EEPROM 34, information about diverse initial settings input by a user is stored.

The controller 3 includes a first motor driver IC 40 configured to control a feeding motor 41 that is a drive source of the feeder roller 9, a second motor driver IC 42 configured to drive a conveying motor 43 that is a drive source of the conveying rollers 10 and 11, a third motor driver IC 44 configured to drive a discharge motor 45 that is a drive source of the discharge rollers 12 and 13, a fourth motor driver IC 46 configured to drive a carriage motor 46 that is a drive source of the carriage 18, and a head driver IC 48 configured to operate a piezoelectric element provided to the recording head 19. The driver ICs 40, 42, 44, 46 and 48 are connected to the ASIC 35.

The CPU 31 is configured to receive an execution request of a print job from the user via an operation unit provided to the housing 14 or an external input unit. The CPU 31 that receives an execution request of a print job is configured to output an execution command of the print job to the ASIC 35. The ASIC 35 is configured to drive each of the driver ICs 40, 42, 44, 46 and 48 at a predetermined timing, based on the execution command. Thereby, the recording media 90 in the accommodation part 2 are fed in order from the uppermost recording medium by the feeder roller 9, and are conveyed along the conveying path 6. The recording medium 90 is conveyed onto the platen 5 by the conveying rollers 10 and 11, and the recording head 19 reciprocally scans the recording medium 90 in conformity to an operation of the carriage 18. At this time, the piezoelectric element of the recording head 19 is driven at a predetermined timing, so that ink is ejected from the ink nozzles. As a result, the printing is sequentially performed on the recording medium 90 from an upstream side toward a downstream side in the conveying direction. The recording medium 90 on which the printing is completed is discharged to an outside of the housing 14 by the discharge rollers 12 and 13.

As shown in FIGS. 1 and 2, the image recording apparatus 1 further includes the recording medium detection unit 8 located above the support surface 2*a* and between the feeder roller 9 and a downstream end of the support surface 2*a* in the conveying direction. The recording medium detection unit 8 is configured to detect the recording medium 90 fed by the feeder roller 9. The recording medium detection unit 8 includes a distance measuring sensor configured to detect a distance D1 from the recording medium 90 accommodated in the accommodation part 2 (for example, a distance between the recording medium detection unit 8 and the recording medium 90 in the direction perpendicular to the support surface 2*a*). The distance measuring sensor is, for example, a photo interrupter, and includes a light-emitting unit configured to emit light toward the recording medium 90 and a light-receiving unit configured to receive light from the light-emitting unit reflected on the recording medium 90. The light-emitting unit and the light-receiving unit are arranged at an end portion (for example, a lower end portion) of the recording medium detection unit 8 on the support surface 2*a* side. In the distance measuring sensor, an output value is changed according to an amount of light received by the light-receiving unit. The output value is larger as the distance D1 is shorter and is smaller as the distance D1 is longer, for example. In the meantime, the type of the distance measuring sensor is not limited thereto. An output of the recording medium detection unit 8 is input to the controller 3.

Figure 3:
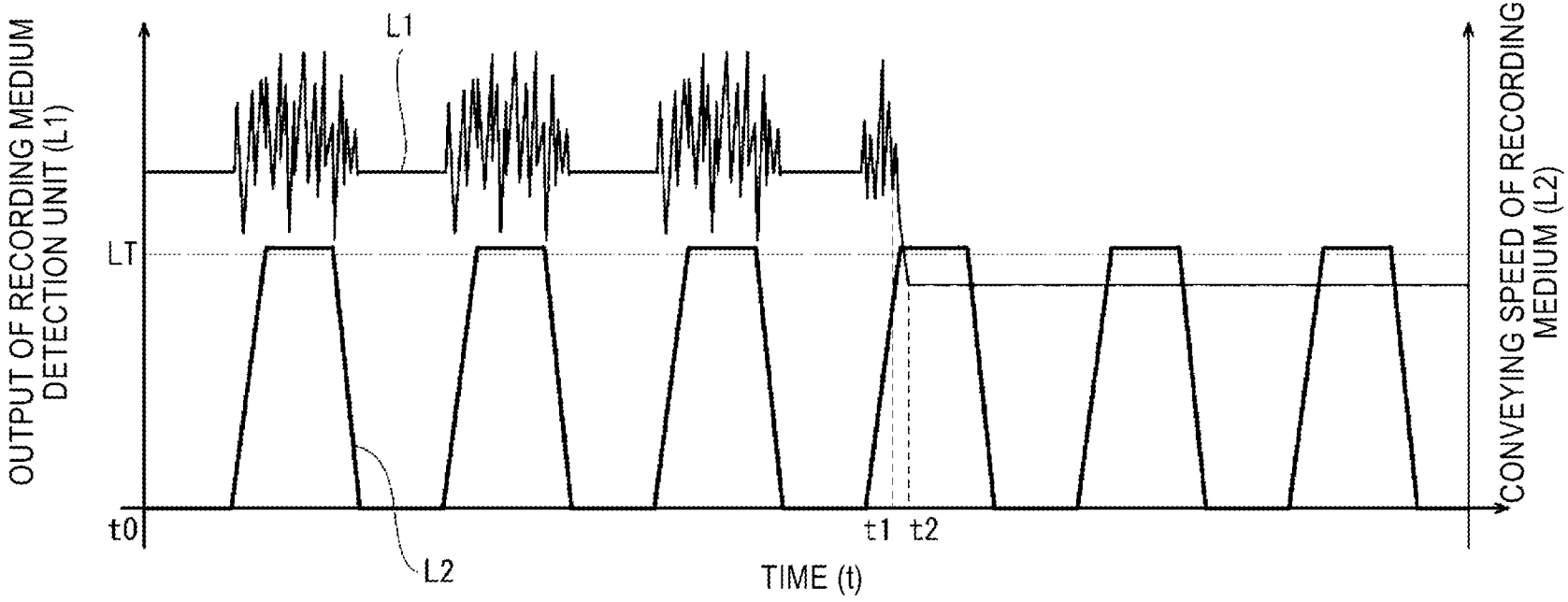
FIG. 3 is a graph depicting a temporal change in output value of a recording medium detection unit, and a temporal change in conveying speed of a recording medium.

FIG. 3 is a graph depicting a temporal change in output value L1 of the recording medium detection unit 8 and a temporal change in conveying speed L2 of the recording medium 90. As shown in FIG. 3, when the plurality of recording media 90 in the accommodation part 2 is fed by the feeder roller 9, the conveying speed L2 changes, for example, periodically. While the recording medium detection unit 8 detects the same recording medium 90 (from time t0 to time t1), the recording medium detection unit 8 detects that the output value L1 is within a reference range (L1≥LT) and the distance D1 is within a preset reference value Ds. Thereafter, when the recording medium 90 deviates from a detection range of the recording medium detection unit 8, the recording medium detection unit 8 detects that the output value L1 is outside of the reference range (L1<LT) and the distance D1 has changed to become larger than the reference value Ds (from time t1 to time t2). Also, after time t2, the recording medium detection unit 8 detects that the output value L1 has changed over time similarly to the time period from time t0 to t1 and the distance D1 is again within the reference value Ds.

In this way, the change of the distance D1 is detected by the recording medium detection unit 8, so that the recording medium detection unit 8 can detect the rear end portion of each of the recording media 90 fed by the feeder roller 9. In the meantime, in order to accurately detect the change of the distance D1 by the recording medium detection unit 8, the recording medium detection unit 8 is preferably arranged to be close to the feeder roller 9 and the recording medium 90 in the accommodation part 2 (for example, a distance between the recording medium detection unit 8 and the feeder roller 9 and a distance between the recording medium detection unit 8 and the recording medium 90 are both several millimeters) on a further downstream side than the feeder roller 9 in the conveying direction.

Figure 4A:
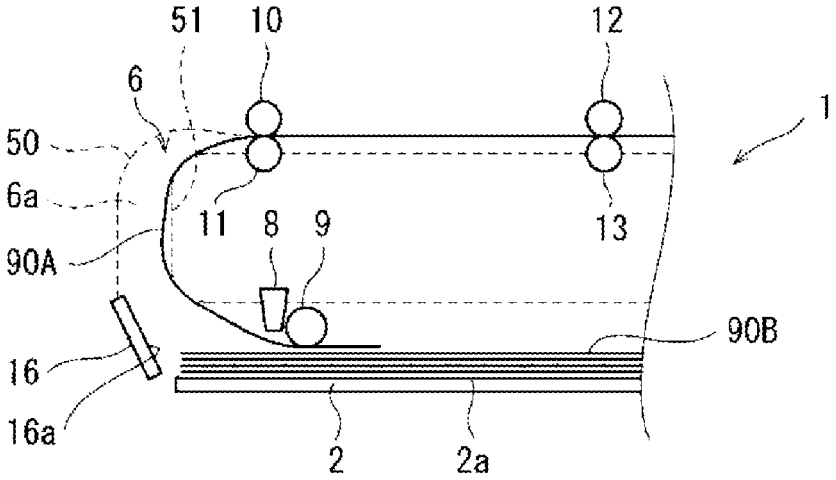
FIG. 4A depicts an aspect of conveying a first recording medium of image recording media shown in FIG. 1.
Figure 4B:
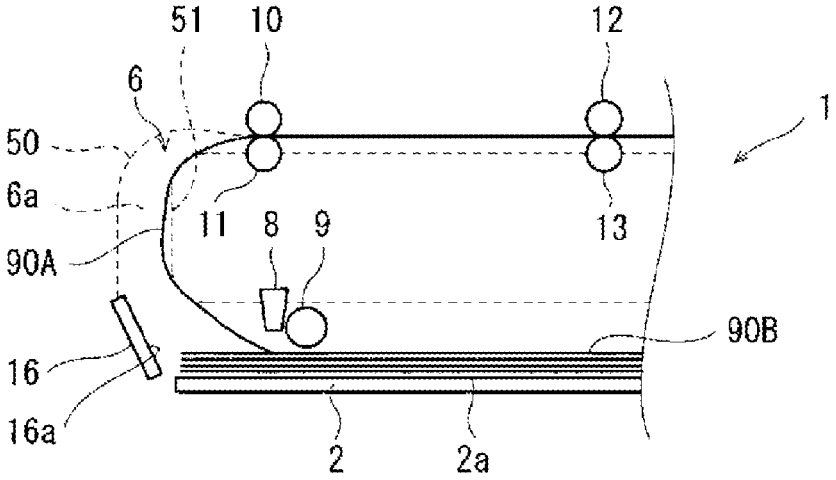
FIG. 4B depicts an aspect of the image recording apparatus shown in FIG. 1 when a recording medium detection unit detects a rear end portion of the first recording medium.
Figure 4C:
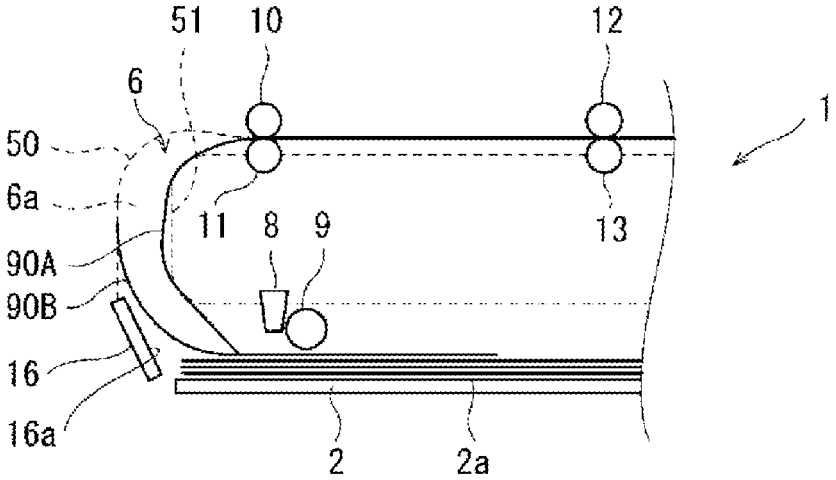
FIG. 4C depicts an aspect of the image recording apparatus shown in FIG. 1 during overlapping processing.

In the image recording apparatus 1 configured as described above, when performing a print job on the plurality of recording media 90, the above-described processes are sequentially performed on each of the recording media 90, and the controller 3 executes the following overlapping processing. FIG. 4A depicts an aspect of conveying the first recording medium 90A of the image recording media shown in FIG. 1. FIG. 4B depicts an aspect of the image recording apparatus shown in FIG. 1 when the recording medium detection unit 8 detects a rear end portion of the first recording medium 90A. FIG. 4C depicts an aspect of the image recording apparatus shown in FIG. 1 during overlapping processing. In FIGS. 4A to 4C, only a part of the image recording apparatus 1 is shown, and an outline of an internal structure of the image recording apparatus 1 defining the conveying path 6 is shown with a broken line.

When the plurality of recording media 90 is conveyed along the conveying path 6, the uppermost first recording medium 90A accommodated in the accommodation part 2 overlaps the recording medium detection unit 8 in the direction perpendicular to the support surface 2*a* and is positioned within the detection range of the recording medium detection unit 8. By rotation drive of the feeder roller 9A, a front end portion (an end portion on a side close to the conveying path 6) of the first recording medium 90A in the conveying direction first comes into contact with the inclined surface 16*a* and the outer guide member 50, and the first recording medium 90A is guided into the conveying path 6. The front end portion of the first recording medium 90A in the conveying direction is nipped between the conveying rollers 10 and 11, so that the first recording medium 90A passes through the reversing path 6*a* while contacting the inner guide member 51 (FIG. 4A). Then, a rear end portion of the first recording medium 90A (a downstream end portion in the conveying direction) is spaced from the feeder roller 9, and the first recording medium 90A deviates from the detection range of the recording medium detection unit 8.

At this time, as shown in FIG. 3, the output value L1 of the recording medium detection unit 8 is within the reference range (L1≥LT) while the first recording medium 90A is positioned within the detection range of the recording medium detection unit 8 (from time t0 to time t1 in FIG. 3), but changes to become outside of the reference range when the first recording medium 90A deviates from the detection range (from time t1 to time t2 in FIG. 3; FIG. 4B). At this time, the rear end portion of the first recording medium 90A fed by the feeder roller 9 is detected by the recording medium detection unit 8. The controller 3 refers to the table stored in the RAM 33 to perceive the distance D1 corresponding to the output value L1 of the recording medium detection unit 8, and determines that the distance D1 has become larger than the reference value Ds when the output value L1 becomes outside of the reference range. Here, in the image recording apparatus 1, since the reversing path 6*a* configured to reverse the front and rear surfaces of the recording medium 90 is arranged between the accommodation part 2 and the recording unit 4, the rear end portion of the first recording medium 90A passing through the reversing path 6*a* is bent toward the support surface 2*a*. That is, the rear end portion of the first recording medium 90A is more floated upward from the second recording medium 90B at a front side part in the conveying direction than at a rear side part. Therefore, when the first recording medium 90A passing through the reversing path 6*a* is spaced from the feeder roller 9, the rear end portion of the first recording medium 90A is spaced from the recording medium detection unit 8 in a direction in which the distance D1 increases. Thereby, since the change of the distance D1 increases before and after the first recording medium 90A is spaced from the feeder roller 9, the recording medium detection unit 8 can appropriately detect the rear end portion of the first recording medium 90A based on the change of the distance D1.

Thereafter, the controller 3 executes overlapping processing of controlling the feeder roller 9 so as to feed the second recording medium 90B in a manner that a front end portion of the second recording medium 90B overlaps the rear end portion of the first recording medium 90A (FIG. 4C). The front end portion of the second recording medium 90B is guided by the inclined surface 16*a* of the inclination part 16, so as to overlap the rear end portion of the first recording medium 90A. In the overlapping processing, the front end portion of the second recording medium 90B is overlapped on a recording surface-side of the rear end portion of the first recording medium 90A. In this way, the controller 3 of the present embodiment controls the feeder roller 9 so as to feed the second recording medium 90B in a case where the distance D1 detected by the recording medium detection unit 8 exceeds the reference value Ds after the feeder roller 9 has started to feed the first recording medium 90A.

As described above, the controller 3 of the image recording apparatus 1 executes the overlapping processing by using the feeder roller 9 in contact with the recording medium 90 accommodated in the accommodation part 2 and the recording medium detection unit 8 configured to detect the recording medium 90 that is fed by the feeder roller 9. For this reason, the feeder roller 9 and the recording medium detection unit 8 can be arranged to overlap each other in the direction perpendicular to the support surface 2*a* of the accommodation part 2, for example. Thereby, it is possible to prevent the image recording apparatus 1 from being enlarged toward an outer side of the support surface 2 in a planar view in order to perform overlapping conveyance of the recording media 90.

Further, the controller 3 performs the overlapping processing based on the detection result of the recording medium detection unit 8 for each recording medium 90 immediately after conveyed from the accommodation part 2. Therefore, it is possible to suppress the conveying path 6 from being complicated in order to perform the overlapping processing. Thereby, it is possible to suppress a mechanism configured to perform overlapping conveyance from being complicated.

The recording medium detection unit 8 controls the feeder roller 9 so as to feed the second recording medium 90B in a case where the distance D1 exceeds the reference value Ds. Thereby, it is possible to control the feeder roller 9 so as to feed the second recording medium 90B based on the change of the distance D1. Therefore, it is possible to implement the overlapping processing with a relatively simple structure.

The recording medium detection unit 8 includes the photo interrupter. Thereby, it is possible to implement the recording medium detection unit 8 that is relatively inexpensive and has highly accurate detection performance.

Hereinafter, a modified embodiment of the first embodiment is described. In an image recording apparatus of the present modified embodiment, the recording medium detection unit 8 includes an ultrasonic sensor. The ultrasonic sensor is, for example, a high frequency-type ultrasonic sensor. Examples of the commercially available ultrasonic sensor include "MA300D1-1" made by Murata Manufacturing Co., Ltd. According to this ultrasonic sensor, ultrasonic waves are emitted toward the recording medium 90 and reflected waves of the emitted ultrasonic waves are received, so that it is possible to achieve the effects, which are similar to the case where the photo interrupter is used, based on a received state of the reflected waves. Hereinafter, other embodiments are described focusing on differences from the first embodiment.

Second Embodiment

Figure 5:
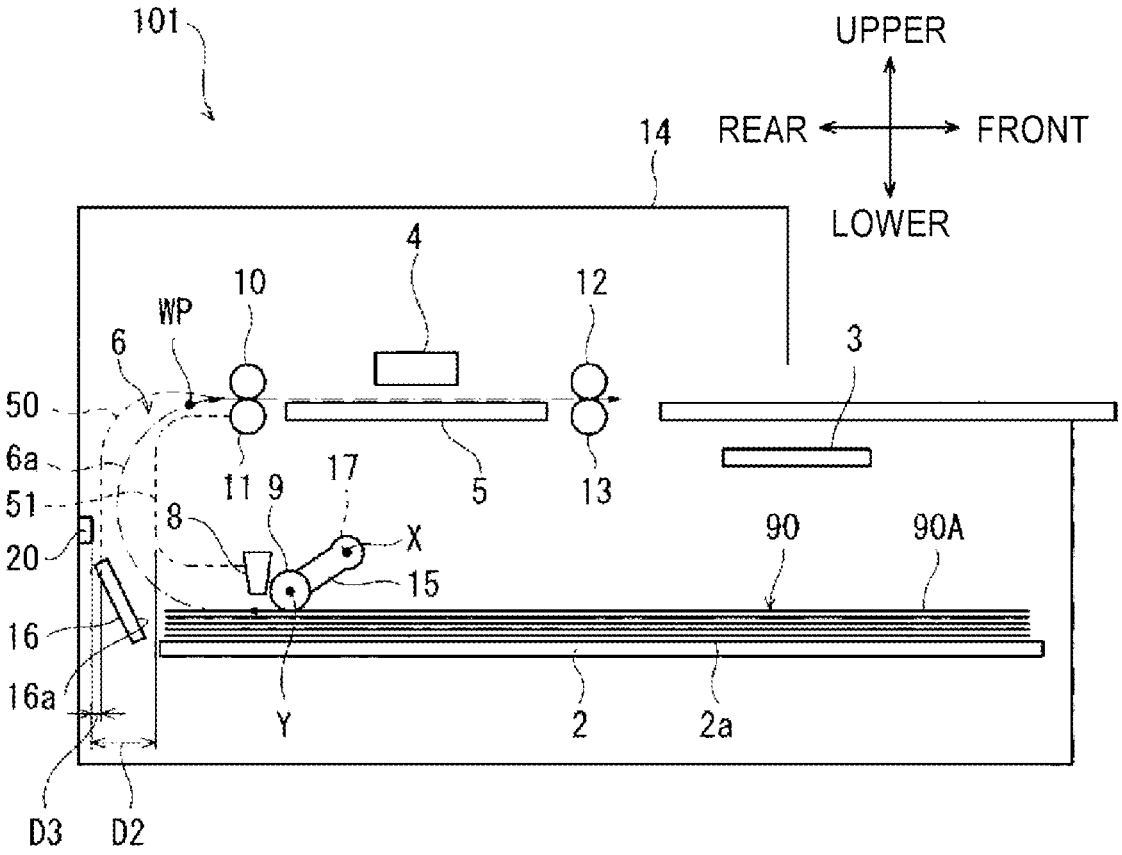
FIG. 5 is a schematic configuration view of an image recording apparatus according to a second embodiment.

FIG. 5 is a schematic configuration view of an image recording apparatus 101 according to a second embodiment. The image recording apparatus 101 further includes a tip end detection unit 20 arranged on the conveying path 6 between the accommodation part 2 and the conveying rollers 10 and 11. The tip end detection unit 20 is configured to detect a tip end portion of the recording medium 90 that is conveyed. Here, the tip end detection unit 20 is arranged between the accommodation part 2 and the reversing path 6*a* in the conveying direction and is configured to detect the recording medium 90 passing through the inclination part 16. The tip end detection unit 20 is fixed to an inner side of the housing 14 exposed to the conveying path 6, for example.

The tip end detection unit 20 is, for example, a photo interrupter. The type of the tip end detection unit 20 is not limited thereto. The tip end detection unit 20 may also be a roller that rotates when coming into contact with the tip end portion of the recording medium 90 and a power generation device that generates power by rotation of the roller, for example. The tip end detection unit 20 may have a contact part arranged to contact the tip end portion of the recording medium 90 and an output part connected to the contact part and whose output changes before and after the contact between the contact part and the recording medium 90, for example. Examples of the contact part include a lever arranged so that a position thereof can change by coming into contact with the tip end portion of the recording medium 90, and examples of the output part include a switch element that is turned on or off by a position of the lever.

In the overlapping processing, the controller 3 executes standby processing of causing the second recording medium 90B to stand by in a state where the front end portion of the second recording medium 90B is located in a predetermined standby position WP on an upstream side of the conveying rollers 10 and 11 in the conveying direction, when the tip end detection unit 20 detects the front end portion of the second recording medium 90B. In the overlapping processing, the controller 3 also executes re-conveying processing of resuming conveyance of the second recording medium 90B in a manner that the front end portion of the second recording medium 90B overlaps the rear end portion of the first recording medium 90A in conformity to a size of a margin of the rear end portion of the first recording medium 90A recorded by the recording unit 4. Here, the controller 3 can perceive the size of the margin of the rear end portion of the first recording medium 90A by an amount of image data that is to be printed on the first recording medium 90A by the recording unit 4, for example. The standby processing and the re-conveying processing can be implemented by the controller 3 controlling the motor driver ICs 40 and 42 so as to drive at least one of the feeder roller 9 and the conveying roller 10 at a predetermined timing.

According to the image recording apparatus 101, since the tip end portion of the second recording medium 90B can be detected by the tip end detection unit 20, it is easy to overlap the tip end portion of the second recording medium 90B on a correct position of the rear end portion of the first recording medium 90A. Also, the controller 3 executes the standby processing and the re-conveying processing, so that it is possible to individually adjust an overlapping amount between the first recording medium 90A and the second recording medium 90B according to an amount of image data that is to be printed on the first recording medium 90A. Therefore, while preventing the overlapping conveyance mechanism from being complicated, it is possible to perform the overlapping conveyance further efficiently.

Since the tip end detection unit 20 is arranged between the accommodation part 2 and the reversing path 6*a* in the conveying direction and is configured to detect the recording medium 90 passing through the inclination part 16, for example, it is possible to accurately detect the tip end portion of the recording medium 90 by the tip end detection unit 20 while preventing the unnecessary double feeding of the recording media 90 by bringing the recording medium 90 into contact with the inclined surface 16*a* of the inclination part 16.

According to the image recording apparatus 101, for example, a shortest distance D2 between the tip end detection unit 20 and the inner guide member 51 is larger than a shortest distance D3 between the tip end detection unit 20 and the outer guide member 50. Here, when the first recording medium 90A passes through the reversing path 6*a*, the tip end portion thereof is nipped between the conveying rollers 10 and 11, so that the first recording medium is likely to contact the inner guide member 51. In contrast, the second recording medium 90B is likely to contact the outer guide member 50 in an early stage of passing through the reversing path 6*a*. Therefore, the shortest distances D2 and D3 are set as described above, so that the tip end portion of the second recording medium 90B can be more easily detected than the tip end portion of the first recording medium 90A by the tip end detection unit 20. Thereby, for example, even in a case where the two recording media 90 are double fed, the tip end portion of the second recording medium 90B can be accurately detected by the tip end detection unit 20.

Third Embodiment

Figure 6:
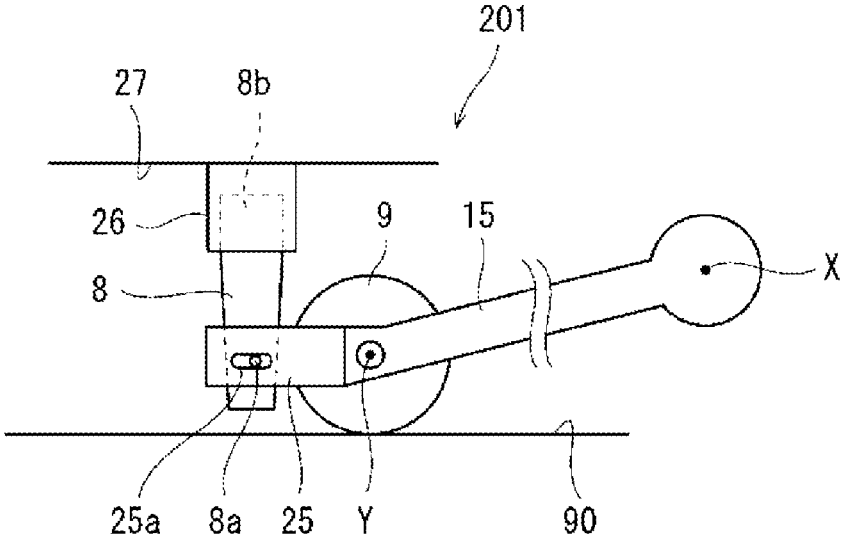
FIG. 6 is a partial view depicting a configuration of a feeder roller and its periphery of an image recording apparatus according to a third embodiment.

FIG. 6 is a partial view depicting a configuration of the feeder roller 9 and its periphery of an image recording apparatus 201 according to a third embodiment. The image recording apparatus 201 includes a support part 25 supporting both the feeder roller 9 and the recording medium detection unit 8. The support part 25 is pivotally supported to be swingable together with the feeder roller 9 in a plane perpendicular to the rotation axis X. The recording medium detection unit 8 is supported by the support part 25 so that a posture of the recording medium detection unit 8 in a direction perpendicular to the support surface 2*a* is maintained during the swinging of the feeder roller 9. Thereby, in the present embodiment, the lower end portion of the recording medium detection unit 8 faces downward in the vertical direction all the time during the swinging of the feeder roller 9. The support part 25 is connected to the swinging member 15.

For example, the support part 25 of the present embodiment has a long hole 25*a* extending in the conveying direction, when viewed in the direction of the rotation axis Y of the feeder roller 9. The recording medium detection unit 8 has a shaft part 8*a* that is arranged in the long hole 25*a* so as to be reciprocally moveable in a longitudinal direction of the long hole 25*a* and is supported by a peripheral edge of the long hole 25*a*. The shaft part 8*a* extends in the direction of the rotation axis Y.

A guide member 26 that is opened toward the support surface 2*a* is provided to the recording medium detection unit 8 on an opposite side of the support surface 2*a*. An end portion 8*b* of the recording medium detection unit 8 on an opposite side of the support surface 2*a* is inserted in the guide member 26 from the opening of the guide member 26, and is supported by the guide member 26 so as to be reciprocally moveable in the direction perpendicular to the support surface 2*a*. The guide member 26 is positioned by being fixed to a fixing part 27 provided inside of the housing 14.

According to the image recording apparatus 201, the support part 25 causes the recording medium detection unit 8 to reciprocally move in the direction perpendicular to the support surface 2*a* via the peripheral edge of the long hole 25*a*, following the swinging operation of the swinging member 15 around the rotation axis X. At this time, the recording medium detection unit 8 is guided in the direction perpendicular to the support surface 2*a* by the guide member 26. As a result, a posture of the recording medium detection unit 8 in the direction perpendicular to the support surface 2*a* is maintained during the swinging of the feeder roller 9. Thereby, even when the plurality of recording media 90 in the accommodation part 2 is sequentially fed by the feeder roller 9 and a stacked amount of the plurality of recording media 90 supported on the support surface 2*a* decreases, the distance D1 in the direction perpendicular to the support surface 2*a* between the uppermost recording medium 90 of the recording media 90 supported on the support surface 2*a* and the recording medium detection unit 8 is maintained substantially constant. Therefore, it is possible to stably detect the rear end portion of the first recording medium 90A fed by the feeder roller 9 by the recording medium detection unit 8, irrespective of the stacked amount of the plurality of recording media 90 supported on the support surface 2*a*.

The present disclosure is not limited to the embodiments, and the configuration and method of the present disclosure can be changed, added or deleted without departing from the spirit of the present disclosure. The recording medium 90 may be paper, or a sheet made of a material (for example, resin or metal) other than paper. The motors 41, 43 and 45 may not be individually provided, and one of the motors may also serve as any of the other motors.

As described above, an aspect of the present disclosure achieves the effects of preventing the image recording apparatus configured to perform overlapping conveyance from being enlarged and to suppress the mechanism configured to perform overlapping conveyance from being complicated. Therefore, it is useful to widely apply the present disclosure to image recording apparatuses capable of achieving the effects.

What is claimed is:

1. An image recording apparatus comprising:

a recording unit configured to perform recording on a sheet-shaped recording medium;

an accommodation part configured to accommodate therein a plurality of recording media and having a support surface on which the plurality of the recording media is supported in a stacked manner, the plurality of the recording media including a first recording medium and a second recording medium, and the first recording medium being stacked on the second recording medium;

a conveying path along which the plurality of the recording media is conveyed from the accommodation part to the recording unit;

a feeder roller pivotally supported so as to contact the plurality of the recording media accommodated in the accommodation part from above, the feeder roller being configured to sequentially feed the plurality of recording media in a conveying direction of the plurality of the recording media;

a reversing path configuring at least a part of the conveying path between the accommodation part and the recording unit, the reversing path being configured to convey the plurality of the recording media while reversing front and rear surfaces of the plurality of the recording media;

a recording medium detection unit located above the support surface and between the feeder roller and a downstream end of the support surface in the conveying direction, the recording medium detection unit being configured to detect the plurality of the recording media fed by the feeder roller; and a controller configured to control the feeder roller so as to feed the second recording medium in a manner that a front end portion of the second recording medium overlaps a rear end portion of the first recording medium, the control being performed by the controller in response to the recording medium detection unit detecting the rear end portion of the first recording medium fed by the feeder roller.

2. The image recording apparatus according to claim 1, wherein the recording medium detection unit includes a distance measuring sensor configured to detect a distance between from the plurality of the recording media and the distance measuring sensor accommodated in the accommodation part, and wherein the controller controls the feeder roller so as to feed the second recording medium in a case where the distance detected by the distance measuring sensor exceeds a reference value after the feeder roller has started to feed the first recording medium.

3. The image recording apparatus according to claim 1, further comprising:

a conveying roller configured to convey the plurality of the recording media fed from the accommodation part along the conveying path; and a tip end detection unit arranged on the conveying path between the accommodation part and the conveying roller, the tip end detection unit being configured to detect a tip end portion of the plurality of the recording media that is conveyed.

4. The image recording apparatus according to claim 3, further comprising:

an inclination part arranged between the accommodation part and the reversing path in the conveying direction, the inclination part having an inclined surface inclined obliquely upward from a downstream end of the accommodation part in the conveying direction toward the reversing path, and the inclination part being configured to guide the plurality of the recording media that is conveyed, wherein the tip end detection unit is arranged between the accommodation part and the reversing path in the conveying direction and is configured to detect the plurality of the recording media passing through the inclination part.

5. The image recording apparatus according to claim 3, further comprising:

an outer guide member defining at least a part of an outer periphery side of the reversing path viewed in a direction of a rotation axis of the feeder roller, and an inner guide member defining at least a part of an inner periphery side of the reversing path viewed in the direction of the rotation axis of the feeder roller, the inner guide member facing the outer guide member at a position closer to the feeder roller than the outer guide member, wherein a shortest distance between the tip end detection unit and the inner guide member is larger than a shortest distance between the tip end detection unit and the outer guide member.

6. The image recording apparatus according to claim 3, wherein in the controlling of the feeder roller so as to feed the second recording medium, the controller is configured to, cause the second recording medium to stand by in a state where the front end portion of the second recording medium is located in a predetermined standby position on an upstream side of the conveying roller in the conveying direction, when the tip end detection unit detects the front end portion of the second recording medium, and resume conveyance of the second recording medium in a manner that the front end portion of the second recording medium overlaps the rear end portion of the first recording medium in conformity to a size of a margin of the rear end portion of the first recording medium recorded by the recording unit.

7. The image recording apparatus according to claim 1, wherein the recording medium detection unit includes a photo interrupter.

8. The image recording apparatus according to claim 1, wherein the recording medium detection unit includes an ultrasonic sensor.

9. The image recording apparatus according to claim 1, further comprising:

a support part supporting both the feeder roller and the recording medium detection unit.

10. The image recording apparatus according to claim 9, wherein the feeder roller is pivotally supported so as to be swingable together with the support part in a plane perpendicular to a rotation axis of the feeder roller, and wherein the recording medium detection unit is supported by the support part so that a posture of the recording medium detection unit in a direction perpendicular to the support surface is maintained during swinging of the feeder roller.

11. The image recording apparatus according to claim 1, wherein at least a part of the feeder roller overlaps the support surface in a direction perpendicular to the support surface, at least a part of the recording medium detection unit overlaps the support surface in the direction perpendicular to the support surface, and at least a part of the reversing path overlaps the support surface in the direction perpendicular to the support surface.

* * * * *